US007344135B2

(12) United States Patent
Fukushima

(10) Patent No.: US 7,344,135 B2
(45) Date of Patent: Mar. 18, 2008

(54) SHEET-MATERIAL CARRYING DEVICE

(75) Inventor: Kimitake Fukushima, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 418 days.

(21) Appl. No.: 11/082,698

(22) Filed: Mar. 18, 2005

(65) Prior Publication Data

US 2005/0206073 A1 Sep. 22, 2005

(30) Foreign Application Priority Data

Mar. 22, 2004 (JP) ..... 2004-083380

(51) Int. Cl.
*B65H 9/00* (2006.01)

(52) U.S. Cl. ..... 271/226; 271/224; 396/612

(58) Field of Classification Search ..... 271/226, 271/264; 396/612; 198/860.3, 837, 841, 198/836.31
See application file for complete search history.

(56) References Cited

U.S. PATENT DOCUMENTS 5,779,027 A * 7/1998 Ensch et al. ..... 198/841
5,850,907 A * 12/1998 Wenzel et al. ..... 198/838

FOREIGN PATENT DOCUMENTS

JP 8-76299 A 3/1996
JP 8-146536 A 6/1996

* cited by examiner

*Primary Examiner*—Kaitlin S. Joerger
(74) *Attorney, Agent, or Firm*—Sughrue Mion, PLLC

(57) ABSTRACT

A downstream edge of a first guide plate has a convex shape in a carrying direction such that a width thereof gradually reduces from both lateral sides toward the center. A central portion of the downstream edge is formed with a protrusion, a width of which becomes narrower in the carrying direction. An upstream edge of a second guide plate has a concave shape in a reverse direction to the carrying direction so as to correspond to the shape of the downstream edge of the first guide plate. A central portion of the upstream edge is formed with a cutout, a width of which becomes narrower in the carrying direction. The downstream edge of the first guide plate is adjacent to the upstream edge of the second guide plate, and the protrusion is adjacent to the cutout so as to enter thereinto.

9 Claims, 8 Drawing Sheets

SHEET-MATERIAL CARRYING DEVICE

BACKGROUND OF THE INVENTION

1. Field of the Invention

The present invention relates to a sheet-material carrying device comprising a plurality of guide members for guiding a sheet material in a carrying direction.

2. Description of the Related Art

An image recording apparatus for recording an image on a sheet-shaped recording material is known. In such an image recording apparatus, the image is recorded in a scanning direction by a recorder while the recording material is fed in a sub-scanning direction perpendicular to the scanning direction. This kind of the image recording apparatus is provided with a plurality of guide members for guiding movement of the recording material to be fed in the sub-scanning direction. Meanwhile, if vibration is transmitted to the recorder from devices disposed at upstream and downstream sides of the recorder, adverse influences of image unevenness and so forth are caused. In order to prevent such adverse influences, the guide member provided on the recorder is independent from the guide members provided on the devices of the upstream and downstream sides of the recorder.

However, when the guide members are independent relative to the recorder and the anteroposterior devices thereof such as described above, a minute step exists at a joint portion of the adjacent guide members. Therefore, a posterior end of the recording material passes the step while the recorder records an image on the recording medium, and at this time, there arises a problem in that one line occurs on the image by a shock, which is caused when the posterior end of the recording material falls from the step. Although the step of the joint portion may be limited to about 0.5 mm in a conventional apparatus, it is difficult to always keep the step of 0.5 mm at a joint portion of units where the units move by ±1.0 mm due to accuracy of its parts. In order to deal with this, there is a well-known method in which a joint portion of adjacent guide members has a comb-tooth structure. By disposing the guide members so as to mesh with each other, shock is reduced when the posterior end of the recording material passes the joint portion (see Japanese Patent Laid-Open Publication Nos. 8-76299 and 8-146536, for instance).

However, even if the joint portion of the adjacent guide members has the simple comb-tooth structure such as described in the above-noted Publications, there arises a problem in that an anterior end of the recording material is caught by the joint portion when the recording materials having different sizes, different paper quality, and different curl are carried in a photographic printer and so forth. It is difficult to make all of the recording materials pass the joint portion without fail.

SUMMARY OF THE INVENTION

In view of the foregoing, it is a primary object of the present invention to provide a sheet-material carrying device in which a sheet material is stably carried.

In order to achieve the above and other objects, the sheet-material carrying device according to the present invention comprises first and second guide members, which are disposed in a carrying direction of a sheet material to guide the sheet material in the carrying direction. A downstream edge of the first guide member has a convex shape in the carrying direction such that a breadth thereof gradually reduces from both sides toward the center in a width direction perpendicular to the carrying direction. An upstream edge of the second guide member has a concave shape in the carrying direction so as to correspond to the shape of the downstream edge of the first guide member. The first and second guide members are disposed so as to make the downstream edge of the first guide member adjacent to the upstream edge of the second guide member.

In a preferred embodiment, one of the downstream edge and the upstream edge is formed with a protrusion, which projects toward the other thereof and is situated at a central portion of the edge. The other of the downstream edge and the upstream edge is formed with a cutout, which has a larger size in comparison with the protrusion and is situated at a central portion of the edge. The first and second guide members are adjacent so as to enter the protrusion into the cutout. It is preferable that the protrusion has a convex shape such that a length thereof in the width direction becomes narrower toward the opposite edge. Further, it is preferable that the cutout has a shape such that a length thereof in the width direction becomes wider toward the opposite edge.

The first and second guide members are included in a skew-correcting device, which corrects a skew of the sheet material so as to make an anterior end of the sheet material parallel to the width direction. An inclination of both sides of the first guide member is adjustable in the width direction perpendicular to the carrying direction.

It is preferable to comprise a carrying roller for carrying the sheet material. The carrying roller is rotatable in a reverse direction to the carrying direction.

According to the sheet-material carrying device of the present invention, it is possible to prevent the anterior end of the recording material from being caught by the adjacent edges of the guide members even when carrying the recording materials having different sizes, different paper quality, and different curl. Thus, all of the recording materials surely pass the joint portion of the guide members. Moreover, the shock is reduced when a posterior end of the recording material passes the adjacent edges of the guide members. Thus, it is possible to prevent a vibration from being caused and transferring to front and behind devices.

BRIEF DESCRIPTION OF THE DRAWINGS

The above objects and advantages of the present invention will become apparent from the following detailed description of the preferred embodiments of the invention when read in conjunction with the accompanying drawings, in which.

DETAILED DESCRIPTION OF THE PREFERRED EMBODIMENT(S)

Figure 1:
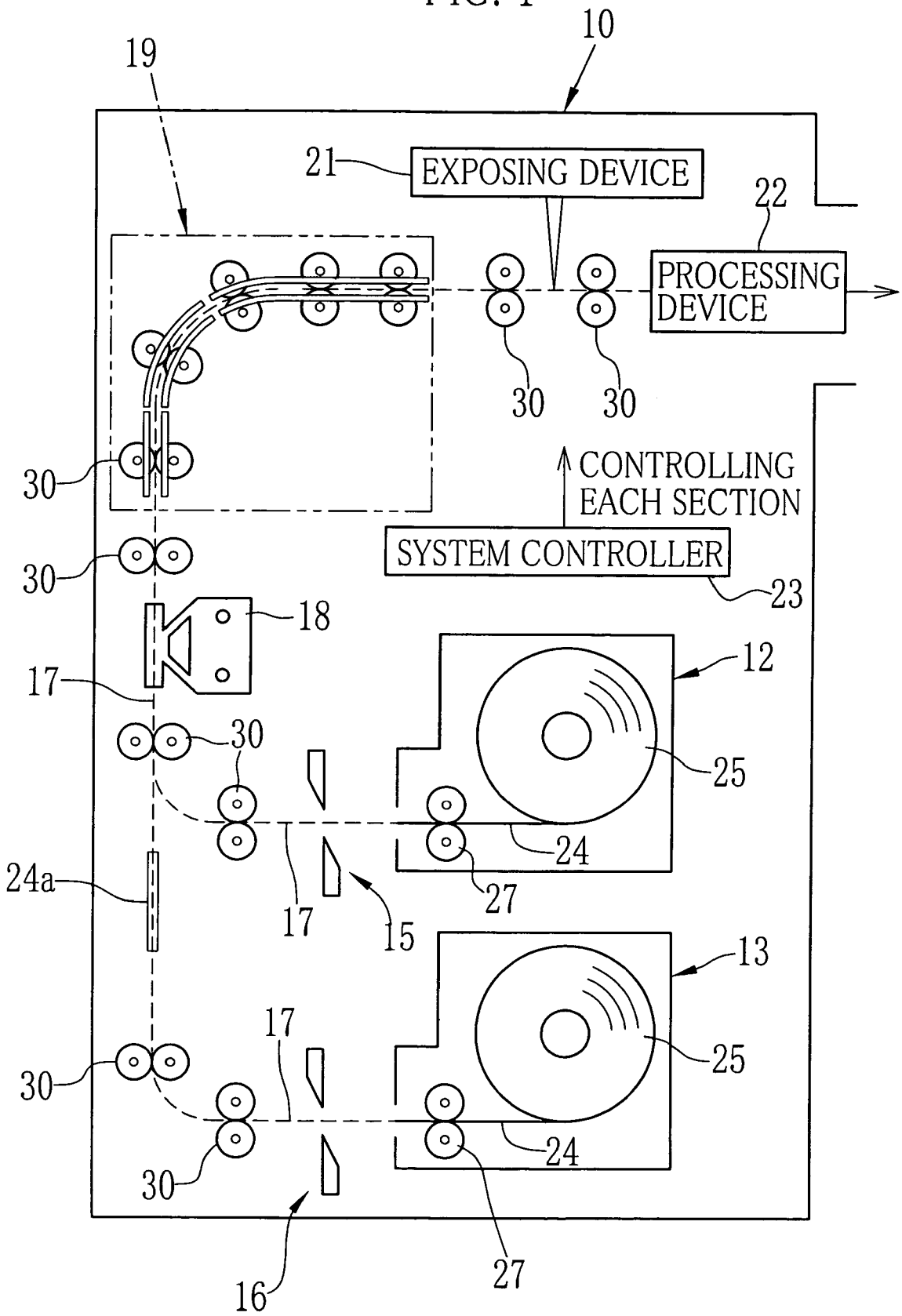
FIG. 1 is a schematic illustration showing a structure of a printer processor.

FIG. 1 is a schematic illustration of a photographic printer 10 employing a carrying device according to the present invention. Such as shown in this drawing, the photographic printer 10 is constituted of magazines 12 and 13, cutters 15 and 16, a back-printing device 18, a skew-correcting device 19, an exposing device 21, a processing device 22, a system controller 23 and so forth.

The magazines 12 and 13 respectively contain a recording-material roll 25 taking up a strip of a photosensitive material 24, which is a recording material, in a roll form. The magazines 12 and 13 are set to predetermined positions in the photographic printer 10, and are provided with paper roller pairs 27 disposed therein. The paper roller pair 27 is rotated by a motor not shown. Upon rotation of the paper roller pairs 27, the photosensitive materials 24 are advanced from the magazines 12 and 13 to the cutters 15 and 16.

The cutters 15 and 16 cut the photosensitive materials 24 into a predetermined length in accordance with a print size to produce a sheet-shaped photosensitive material 24*a*. Incidentally, instead of providing the cutters for the respective magazines, a single cutter may be disposed near the back-printing device 18 to cut the photosensitive materials 24, which are supplied from the respective magazines.

The photosensitive material 24*a* is carried by a plurality of carrying roller pairs 30 along a passage 17 shown by a dotted line in the drawing to pass through the back-printing device 18, the skew-correcting device 19, the exposing device 21 and the processing device 22 in this order. The back-printing device 18 prints information of film ID, a frame number and so forth on a rear surface (opposite surface to a recording surface) of the photosensitive material 24*a*.

The photosensitive material 24*a*, for which back-printing has been performed, is carried to the skew-correcting device 19 by the carrying roller pairs 30. The skew-correcting device 19 corrects a skew of the photosensitive material 24*a* so as to parallelize an anterior end of the photosensitive material 24*a* in a scanning direction of the exposing device 21. The photosensitive material 24*a* of which the skew has been corrected by the skew-correcting device 19 is fed into the exposing device 21.

The exposing device 21 comprises a laser printer and an image memory, which are well known. The image memory stores image data scanned by a film scanner not shown. The exposing device 21 performs scanning exposure relative to the photosensitive material 24*a* fed in a feed direction (sub-scanning direction) perpendicular to the scanning direction. The scanning exposure is performed on the basis of the image data of the image memory in the scanning direction to record an image on the photosensitive material 24*a*. Incidentally, the scanning exposure may be performed on the basis of image data stored in a recording medium of a memory card and so forth. The exposed photosensitive material 24*a* is forwarded to the processing device 22 wherein various processes of coloring/developing, fixing and washing are performed. Successively, a drying process is executed, and then, the photosensitive material is discharged to the outside of the photographic printer 10 as a photo print. In the meantime, although an illustration is abbreviated, plural carrying guides are also disposed so as to confront the passage 17 at the other places of the skew-correcting device 19.

Figure 2:
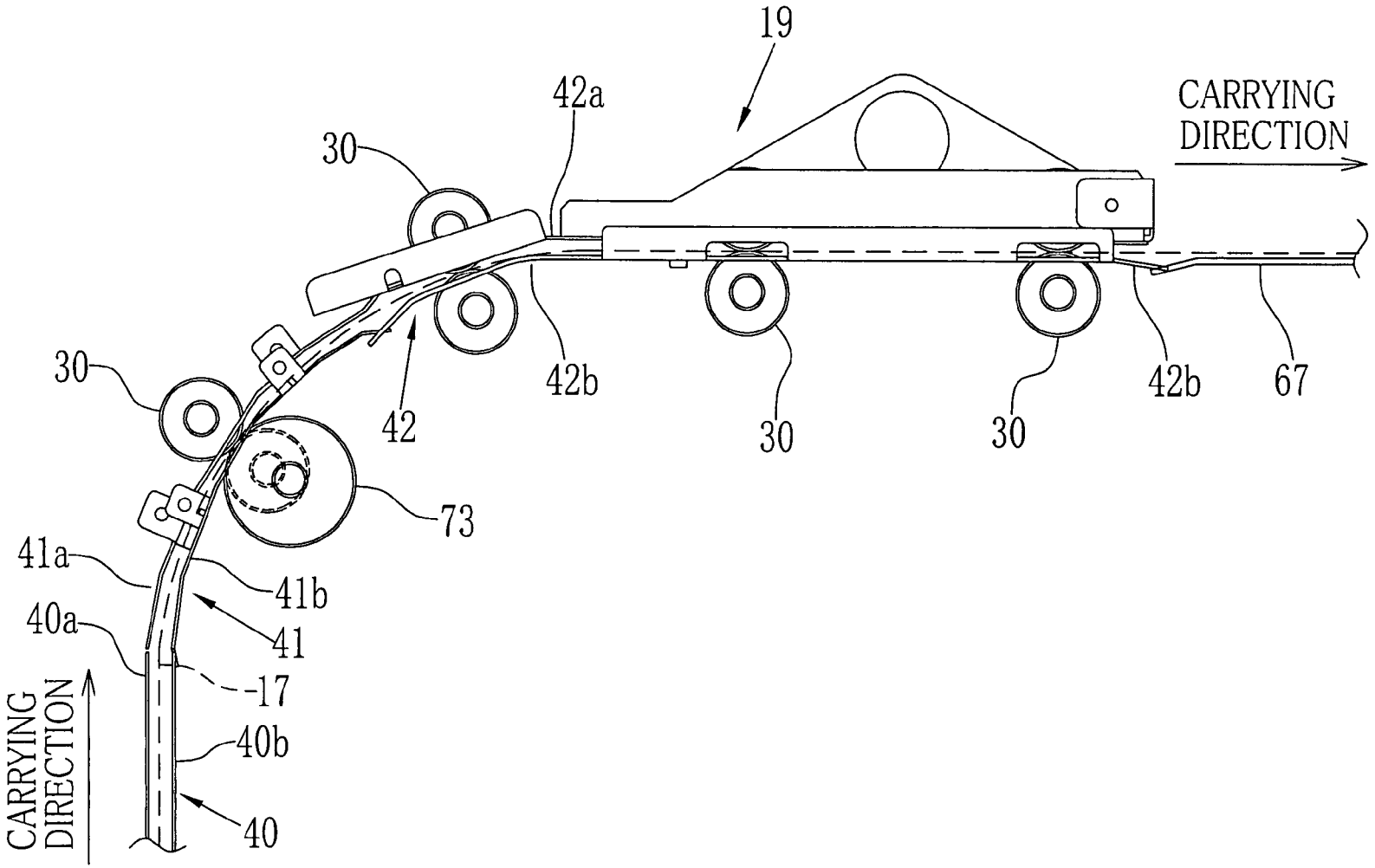
FIG. 2 is a schematic illustration showing a structure of a skew correcting device.

Next, the skew-correcting device 19 being as a preferred embodiment of a sheet-material carrying device is described below. FIG. 2 is a side view of the skew-correcting device 19. Such as shown in this drawing, the skew-correcting device 19 comprises a plurality of the carrying roller pairs 30 and carrying guides 40, 41 and 42. The carrying guide 40 is disposed at the most upstream side in a carrying direction of the photosensitive material. The carrying guide 42 is disposed at the most downstream side in the carrying direction. The carrying guide 41 is disposed between the carrying guides 40 and 42.

The carrying guide 40 is constituted of two guide plates 40*a* and 40*b* having a flat shape and confronting each other so as to nip the passage 17. The carrying guide 41 is constituted of two guide plates 41*a* and 41*b* confronting each other so as to nip the passage 17. The guide plates 41*a* and 41*b* curve in an arc shape.

The carrying guide 42 is constituted of two guide plates 42*a* and 42*b*, which are vertically disposed. Similarly to the guide plates 41*a* and 41*b*, the guide plates 42*a* and 42*b* confront each other so as to nip the passage 17. Upstream sides of the guide plates 42*a* and 42*b* curve in an arc shape to form the arc-shaped passage 17 with the guide plates 41*a* and 41*b*. The arc-shaped passage 17 turns the carrying direction at 90 degrees. Meanwhile, downstream sides of the guide plates 42*a* and 42*b* are flat planes being parallel in the carrying direction. By the way, the carrying roller pairs 30 are manually rotatable in a reverse direction to the carrying direction so that the jammed material is easily removed at the time of occurrence of jam.

Figure 3:
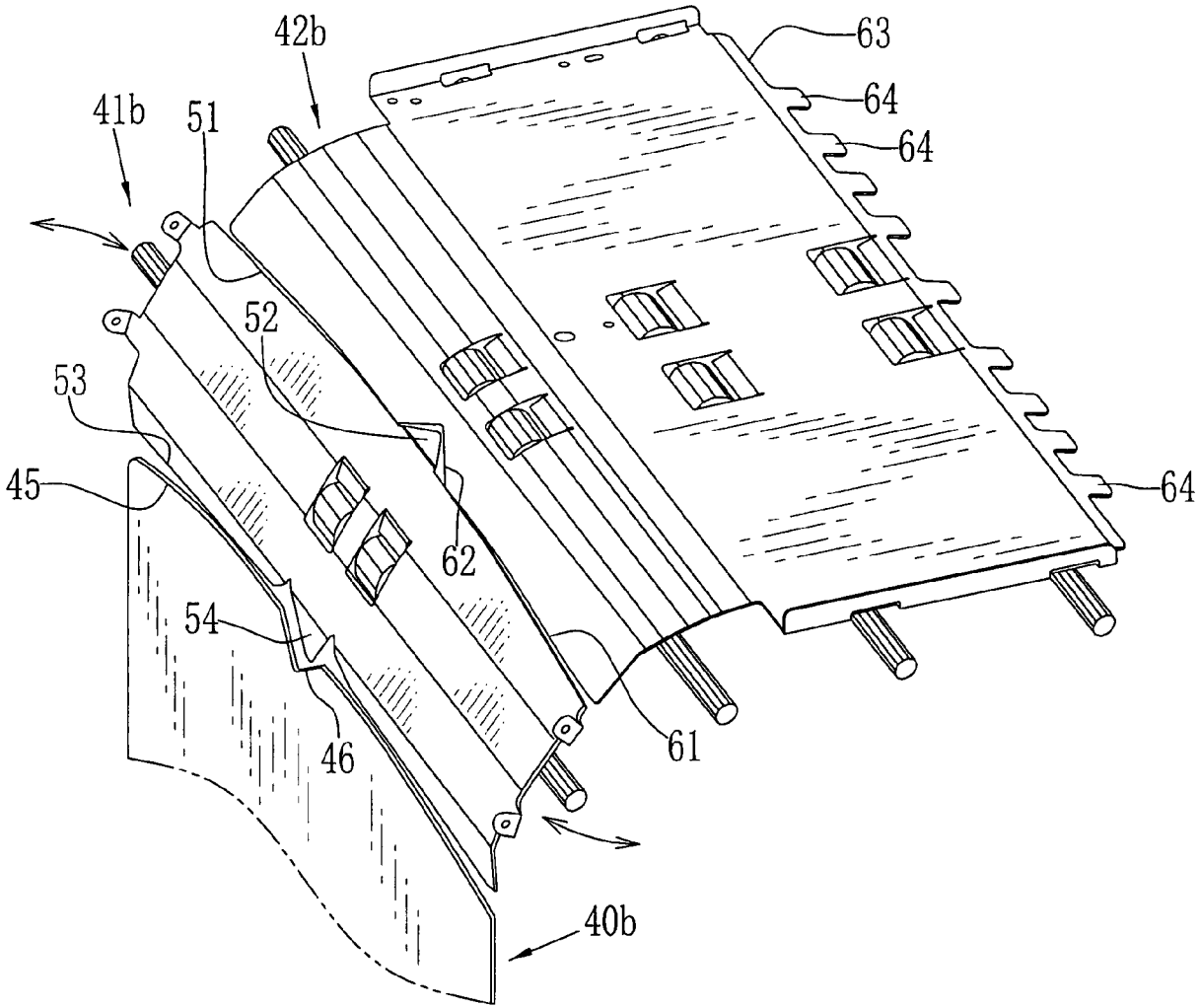
FIG. 3 is a perspective view showing a structure of guide plates of the skew correcting device.
Figure 4:
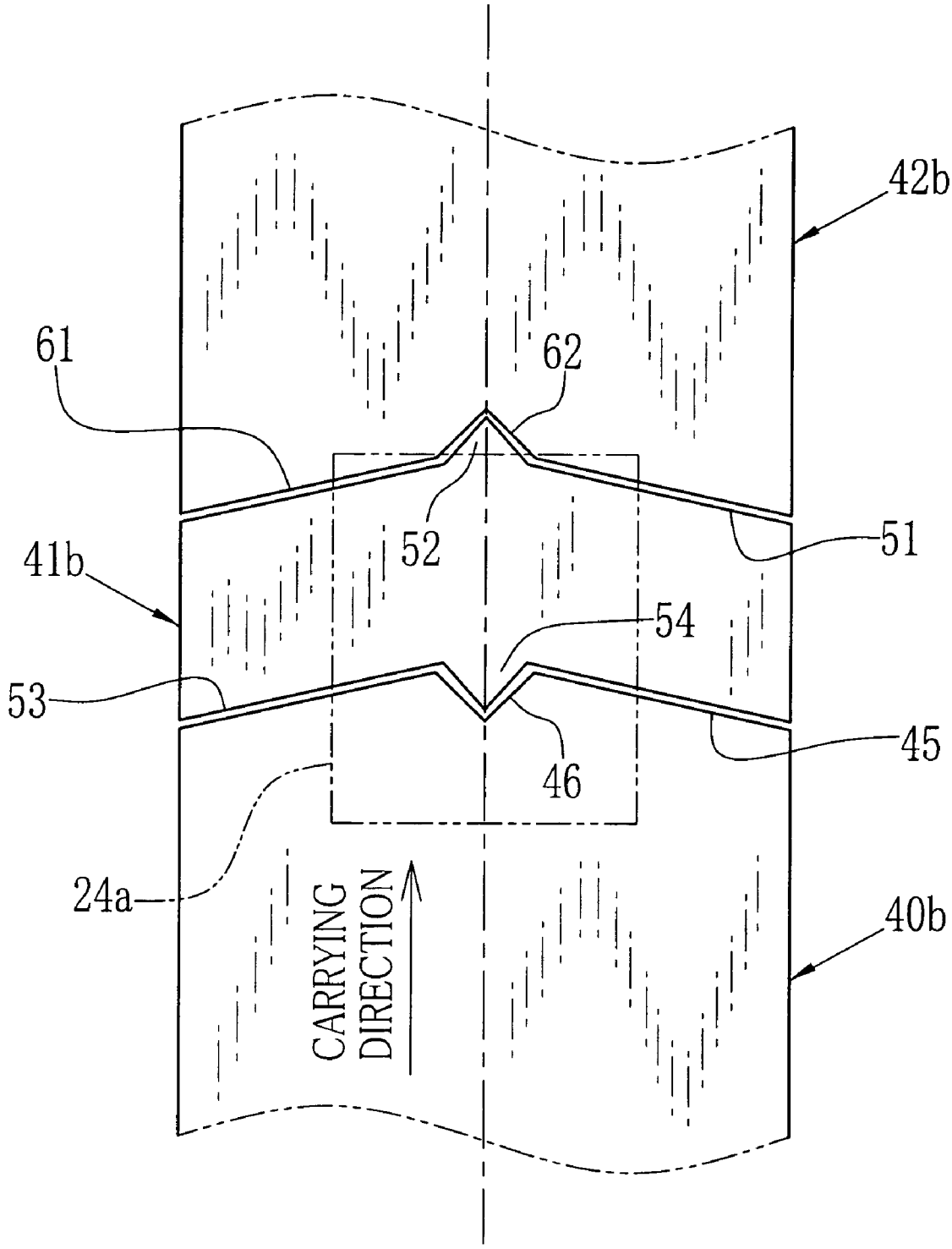
FIG. 4 is a development elevation explaining the structure of the guide plates.

Successively, the guide plates 40*b*, 41*b* and 42*b* disposed at the inside of the passage 17 are described below. These guide plates 40*b*, 41*b* and 42*b* guide the rear surface of the photosensitive material 24 moved in the carrying direction. Such as shown in a perspective view of FIG. 3 and in a development elevation of FIG. 4, a downstream edge 45 of the guide plate 40*b* has a convex shape (inverted-V shape) toward the downstream side in the carrying direction such that a length in a width direction (scanning direction) perpendicular to the carrying direction gradually reduces from both lateral sides of the guide plate 40*b* toward the center thereof. Moreover, a central portion of the edge 45 is formed with a cutout 46. A width of the cutout 46 in the scanning direction becomes wider toward the downstream side. The cutout 46 substantially has an isosceles-triangle shape.

An upstream edge 53 of the guide plate 41*b* has a concave shape (V shape) toward the upstream side so as to correspond to the shape of the downstream edge 45 of the guide plate 40*b*. Moreover, a central portion of the upstream edge 53 is formed with a protrusion 54 substantially having an isosceles-triangle shape. A width of the protrusion 54 in the scanning direction becomes narrower toward the upstream side. The protrusion 54 is inwardly inclined toward the upstream side. A size of the protrusion 54 is adapted to be smaller than the cutout 46.

The guide plates 40*b* and 41*b* are disposed so as to make the edges 45 and 53 adjacent. Thus, the protrusion 54 enters the cutout 46, and the top of the protrusion 54 is located at the inside of the cutout 46. Meanwhile, the maximum widths of the protrusion 54 and the cutout 46 are adapted to be shorter than the minimum width of the photosensitive material 24*a* to be carried.

A downstream edge 51 of the guide plate 41*b* in the carrying direction has a convex shape (reversed-V shape) toward the downstream side such that a width of the edge 51 gradually reduces from lateral sides of the edge 51 toward the center thereof. A central portion of the downstream edge 51 is formed with a protrusion 52 substantially having an isosceles-triangle shape. A width of the protrusion 52 in the scanning direction becomes narrower toward the downstream side. The protrusion 52 inclines downward toward the downstream guide plate 42*b*.

An upstream edge 61 of the guide plate 42*b* has a concave shape (V shape) toward the upstream side so as to correspond to the shape of the downstream edge 51 of the guide plate 41*b*. Further, a central portion of the upstream edge 61 is formed with a cutout 62 substantially having an isosceles-triangle shape. A width of the cutout 62 in the scanning direction becomes narrower toward the downstream side.

The guide plates 41*b* and 42*b* are disposed so as to make the downstream edge 51 of the guide plate 41*b* and the upstream edge 61 of the guide plate 42*b* adjacent. Thus, the protrusion 52 enters the cutout 62, and the top of the protrusion 52 is situated under the cutout 62. Meanwhile, the maximum widths of the protrusion 52 and the cutout 62 in the scanning direction are adapted to be shorter than the minimum width of the photosensitive material to be carried.

A downstream edge 63 of the guide plate 42*b* is formed with a plurality of rectangular protrusions 64 projecting toward the downstream side and inclining downward. The downstream edge 63 is formed with the convex portions, which are the protrusions 64, and concave portions formed between the adjacent protrusions 64 so that the downstream edge 63 has a comb-tooth shape.

As described above, the adjacent portion (joint portion) of the edges 45 and 53 of the guide plates 40*b* and 41*b* has the V-like shape. In addition, the adjacent portion (joint portion) of the edges 51 and 61 of the guide plates 41*b* and 42*b* also has the V-like shape. In virtue of this, even if the photosensitive material 24*a* curls, an anterior end of the photosensitive material 24*a* is prevented from being caught by the adjacent portions. Moreover, when a posterior end of the photo sensitive material 24*a* passes the adjacent portions, a shock to be caused at that time is reduced because the posterior end gradually moves onto the downstream guide plate from the lateral sides of the posterior end toward the center thereof. Further, the protrusion 54 and the cutout 46 are adjacently disposed so as to mesh with each other at the central portion of the adjacent edges 45 and 53. Similarly, the protrusion 52 and the cutout 62 are adjacently disposed so as to mesh with each other at the central portion of the adjacent edges 51 and 61. Thus, even if the photosensitive material 24*a* has a small width size, the posterior end of the photosensitive material 24*a* gradually moves onto the downstream guide plate when passing the adjacent portion.

Figure 5:
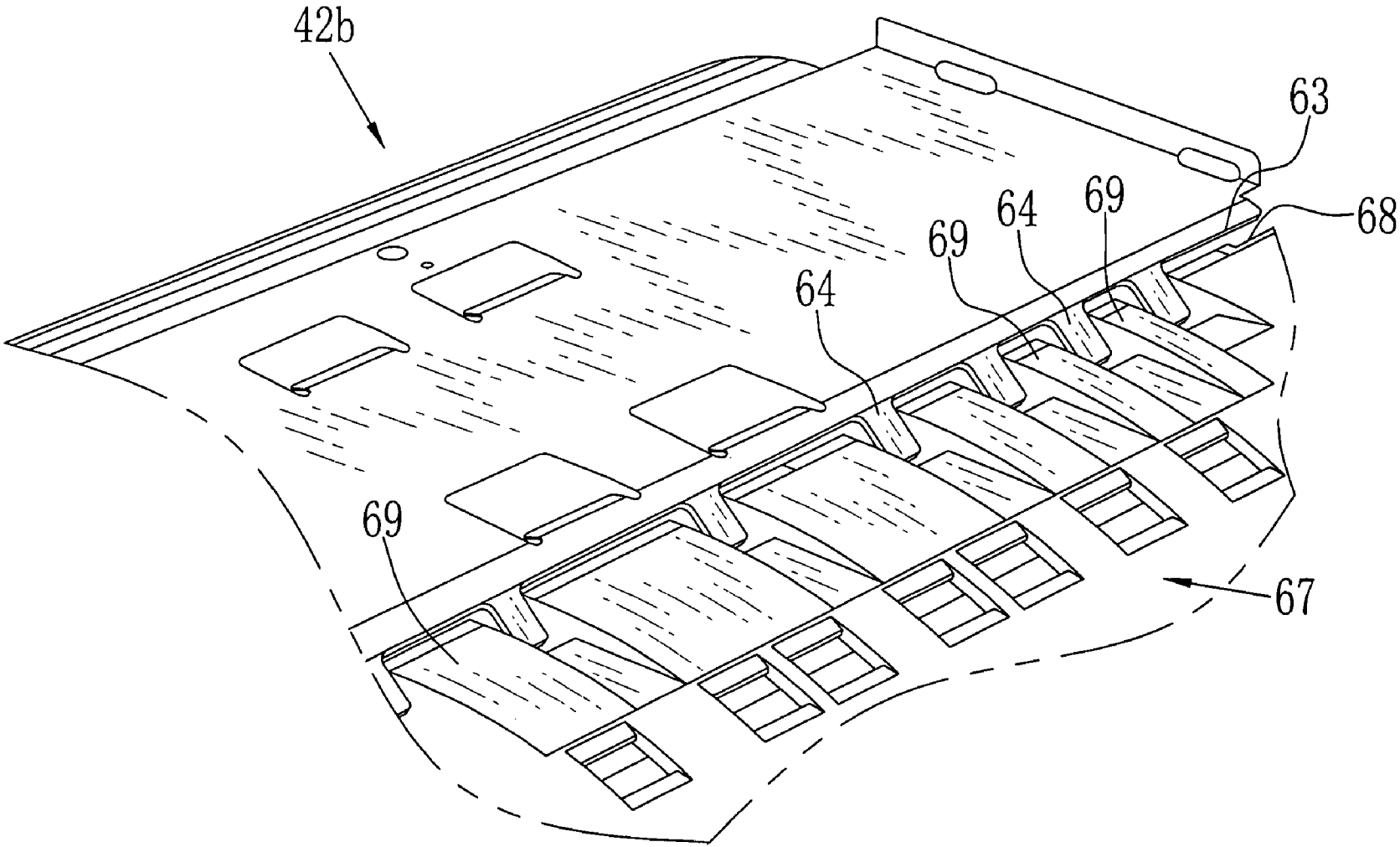
FIG. 5 is a perspective view showing a joint portion of the guide plates of the skew correcting device and an exposing device.

In the meantime, a guide plate 67 is disposed at a downstream side of the guide plate 42*b*. The guide plate 67 guides the photosensitive material 24*a* moving in the exposing device 21 along the sub-scanning direction. Such as shown in FIG. 5, an upstream edge 68 of the guide plate 67 is formed with a plurality of rectangular protrusions 69 projecting toward the upstream side and inclining downward. The upstream edge 68 is formed with the convex portions, which are the protrusions 69, and concave portions formed between the adjacent protrusions 69 so that the upstream edge 68 has a comb-tooth shape. The guide plate 42*b* and the guide plate 67 are adjacently disposed such that the comb-tooth shape of the downstream edge 63 of the guide plate 42*b* meshes with the comb-tooth shape of the upstream edge 68 of the guide plate 67.

In this way, the guide plate 42*b* of the skew-correcting device 19 is independent from the guide plate 67 of the exposing device 21, and these guide plates 42*b* and 67 are adjacently disposed. Since the guide plate 42*b* does not abut on the guide plate 67, it is prevented that a vibration of the skew-correcting device 19 is transmitted to the guide plate 67 of the exposing device 21 to disturb the exposure thereof. Further, since the downstream edge 63 of the guide plate 42*b* and the upstream edge 68 of the guide plate 67 are adjacently disposed so as to mesh with each other, the posterior end of the photosensitive material 24*a* gradually moves from the guide plate 42*b* onto the guide plate 67 when passing the adjacent portion thereof. Thus, a shock is reduced when the posterior end of the photosensitive material 24*a* passes the adjacent portion.

In the above, the guide plates 40*b*, 41*b* and 42*b* disposed at the inside of the passage 17 are merely described. With respect to the guide plates 40*a*, 41*a* and 42*a* disposed at the outside, adjacent edges thereof have a similar structure. However, the guide plates 40*a*, 41*a* and 42*a* are formed without the cutouts 46, 62 and the protrusions 52, 54 differently from the guide plates 40*b*, 41*b* and 42*b*.

The carrying guides 40, 41 and 42 are disposed parallel in the scanning direction of the exposing device 21. Although the carrying guides 40 and 42 are fixed to a body of the photographic printer 10, the carrying guide 41 is rotatable relative to a reference position parallel to the scanning direction of the exposing device 21. The carrying guide 41 is perpendicularly rotatable relative to the passage 17 around the center of the carrying guide 41 in the scanning direction. The skew-correcting device 19 tilts the carrying guide 41 relative to the reference position parallel to the scanning direction so that both sides of the passage 17 in the scanning direction have different passage lengths. By making the passage lengths different, the skew-correcting device 19 corrects a skew of the photosensitive material 24*a* such that the anterior end of the photosensitive material 24*a* becomes parallel to the scanning direction of the exposing device 21. The carrying guide 41 is tilted by a tilt-driving mechanism described later.

Figure 6:
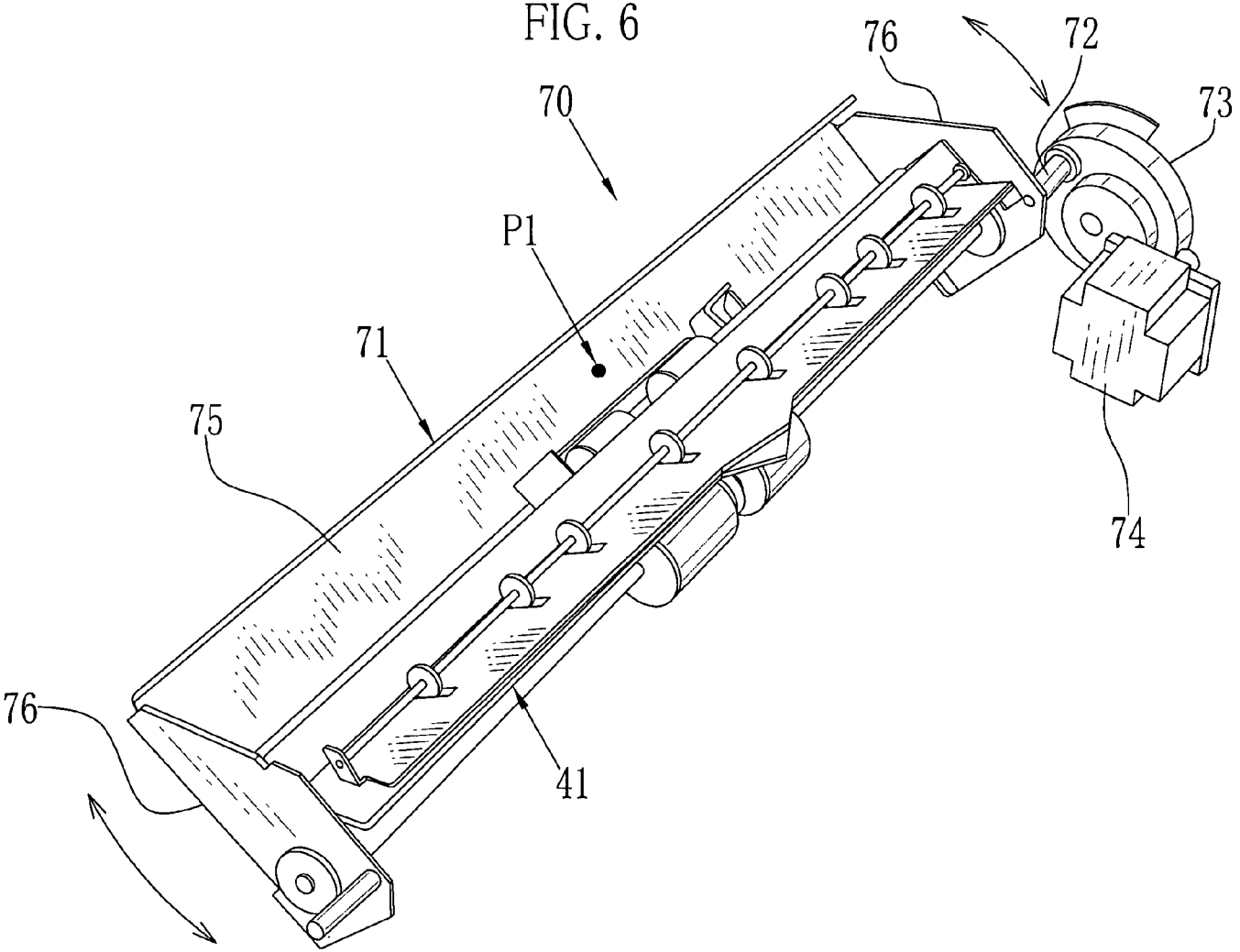
FIG. 6 is a perspective view showing a tilt-driving mechanism.

FIG. 6 is a perspective view showing a structure of the tilt-driving mechanism 70 viewed from under the carrying guide 41. The tilt-driving mechanism 70 comprises a frame 71 for supporting the carrying guide 41, a cam 73 formed with a driving shaft 72 for actuating the frame 71, and a tilt-driving motor 74 for actuating the cam 73.

The frame 71 is perpendicular to the carrying guide 41 and comprises a main body 75 and two side plates 76. The main body 75 is parallel to the scanning direction. The side plates 76 are formed at both ends of the main body 75 so as to be perpendicular thereto. The cam 73 has a circular shape, and one end of the driving shaft 72 is fixed to a position shifted from the center of the circular cam toward the periphery thereof. The other end of the driving shaft 72 is fixed to the side plate 76.

The cam 73 is rotated by the tilt-driving motor 74. Upon rotation of the cam 73, the frame 71 is tilted in a direction shown by an arrow in the drawing, since the driving shaft 72 is fixed to the position shifted from the center toward the periphery such as described above. Thus, the carrying guide 41 is tilted relative to the reference position.

At this time, although the guide plate 41*b* is tilted relative to the guide plates 40*b* and 42*b*, the guide plate 41*b* is prevented from coming into contact with the guide plates 40*b* and 42*b*. This is because the adjacent portions with the guide plates 40*b* and 42*b* have the convex shape, not a com-tooth shape. Similarly, the guide plate 41*a* is also prevented from coming into contact with the guide plates 40*a* and 42*a*. Incidentally, the tilt-driving mechanism 70 is actuated by the controller 23 controlling the whole of the photographic printer 10. The system controller 23 activates the tilt-driving motor 74 to control a tilt amount.

Next, an operation of the skew-correcting device 19 having the above structure is described below. The photosensitive material 24*a*, for which back-printing has been performed in the back-printing device 18, is forwarded to the skew-correcting device 19. When the photosensitive material 24*a* does not have a skew, the system controller 23 controls the carrying roller pairs 30 without controlling the tilt-driving mechanism 70 to carry the photosensitive material 24*a* in a state that the carrying guide 41 is kept in the reference position, namely is parallel to the scanning direction.

When the anterior end of the photosensitive material 24*a* passes the adjacent portion of the carrying guides 40 and 41, and when the anterior end passes the adjacent portion of the carrying guides 41 and 42, it is prevented that the anterior end is caught by the joint portion (adjacent portion) and a jam of the material is caused, even if the photosensitive material 24*a* curls. This is because the adjacent portion has the convex shape (reversed-V shape) toward the downstream side in the carrying direction. Thus, the anterior end of the photosensitive material 24*a* is surely carried.

When the posterior end of the photo sensitive material 24*a* passes the adjacent portion of the carrying guides 40 and 41, and when the posterior end passes the adjacent portion of the carrying guides 41 and 42, the posterior end gradually moves onto the downstream carrying guide. Thus, even if the adjacent portion has a step, a shock to be caused is reduced when the posterior end passes the adjacent portion. In virtue of this, vibration is prevented from being transmitted to the exposing device 21 disposed at the downstream side. Further, since the protrusions 52 and 54 are provided at the centers of the adjacent portions of the guide plates 40*b*, 41*b* and 42*b* so as to mesh with the cutouts 46 and 62, the posterior end gradually moves onto the downstream guide plate even if the photosensitive material 24*a* has a small width size. Thus, a shock to be caused is reduced when the posterior end passes the adjacent portion.

In this way, regardless of the width size of the photosensitive material 24*a*, the anterior end thereof surely passes the adjacent portions of the carrying guides 40, 41 and 42, and at the same time, the shock to be caused is reduced when the posterior end of the photosensitive material 24*a* passes the adjacent portions. Accordingly, it is possible to stably carry the photosensitive material 24*a*.

The photosensitive material 24*a* having passed the adjacent portion of the carrying guides 41 and 42 is further carried to the downstream side of the carrying guide 42 and is fed into the exposing device 21.

In the meantime, when the photosensitive material 24*a* has a skew, the system controller 23 controls the motor 74 of the tilt-driving mechanism 70 to move the carrying guide 41 from the reference position to a predetermined tilt position. And then, the system controller 23 controls the carrying roller pairs 30 to carry the photosensitive material 24*a* toward the downstream side.

At this time, the carrying guide 41 is tilted relative to the carrying guides 40 and 42 so that the passage lengths of the lateral sides of the passage 17 are different. The skew of the photosensitive material 24*a* is corrected such that the anterior end thereof becomes parallel to the scanning direction. Incidentally, since the adjacent portions (joint portions) of the carrying guides 40, 41 and 42 have the convex shape (reversed-V shape) toward the downstream side in the carrying direction, the carrying guide 41 is prevented from coming into contact with the carrying guides 40 and 42 while tilting. It is possible to increase the tilt amount of the carrying guide 41 so that it is possible to expand a range for correcting the skew of the photosensitive material 24*a*.

After that, the photosensitive material 24*a* is carried by the carrying roller pairs 30 along the passage 17, and then, the photosensitive material 24*a* is fed into the downstream exposing device 21.

In case a jam of the material has occurred in the skew-correcting device 19, the carrying roller pair 30 is manually rotated in a reverse direction to the carrying direction. Even if the jammed photosensitive material 24*a* is moved in the reverse direction, the photosensitive material 24*a* is prevented from being caught by the adjacent portions of the carrying guides 40, 41 and 42 because the adjacent portions have the V-like shape toward the upstream side in the carrying direction.

Figure 7:
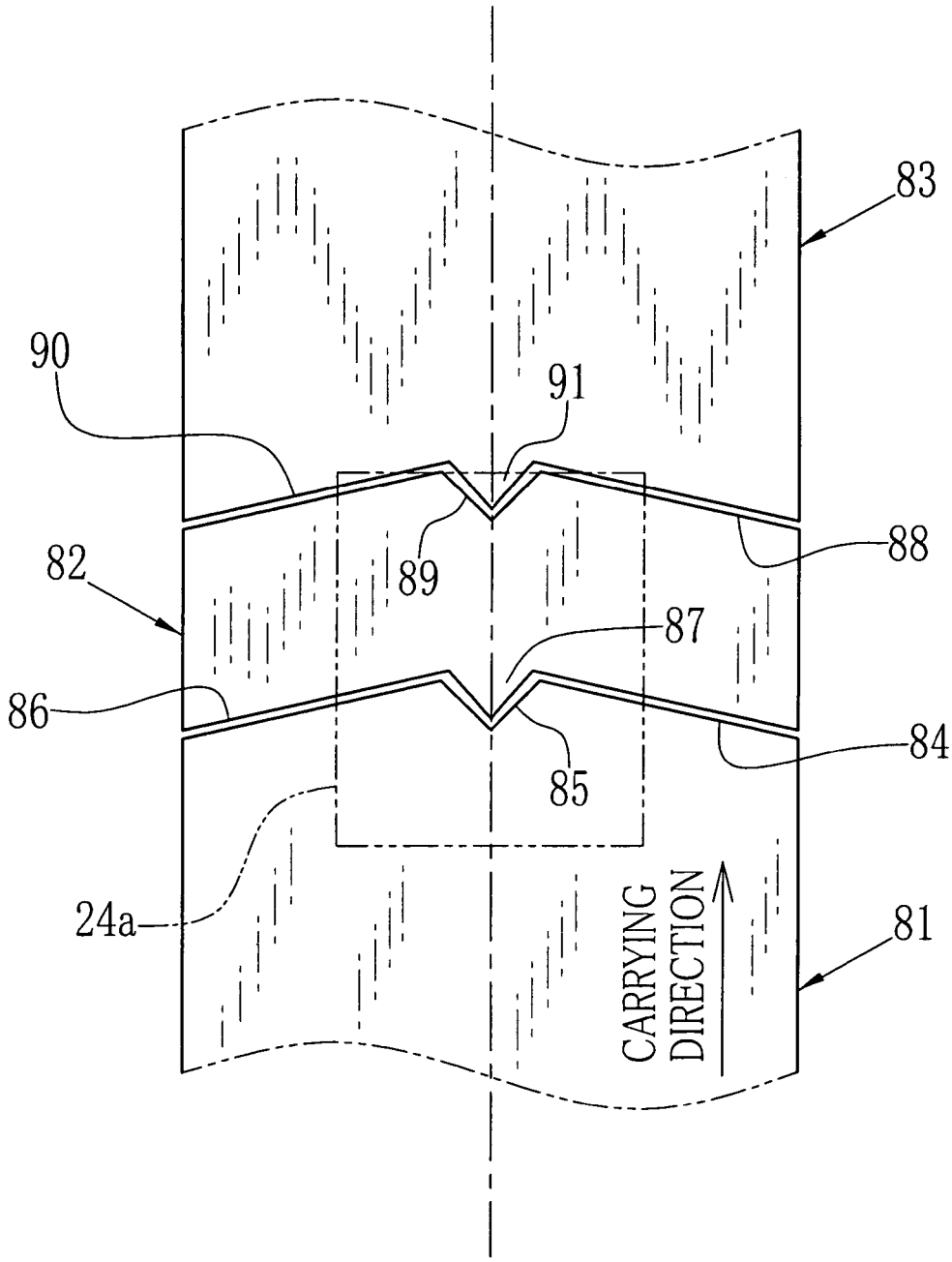
FIG. 7 is a development elevation explaining another embodiment of the guide plate.

With respect to the protrusions 52 and 54 and the cutouts 46 and 62, the positions and the directions thereof are not limited to the above embodiment. For instance, guides plates 81 to 83 may be arranged such as shown in FIG. 7. The guide plate 81 is disposed at the most upstream side in the carrying direction. The guide plate 83 is disposed at the most downstream side in the carrying direction. The guide plate 82 is disposed between the guide plates 81 and 83.

A downstream edge 84 of the guide plate 81 has a convex shape (reversed-V shape) toward the downstream side, and a central portion thereof is formed with a cutout 85. An upstream edge 86 of the guide plate 82 has a concave shape (V shape) toward the upstream side, and a central portion thereof is formed with a protrusion 87 projecting to the upstream side.

A downstream edge 88 of the guide plate 82 has a convex shape (reversed-V shape) toward the downstream side, and a central portion thereof is formed with a cutout 89. An upstream edge 90 of the guide plate 83 has a concave shape (V shape) toward the upstream side, and a central portion thereof is formed with a protrusion 91 projecting to the upstream side.

The cutouts 85 and 89 have a similar shape to the cutouts 46 and 62. The protrusions 87 and 91 have a similar shape to the protrusions 52 and 54. The guide plates 81 to 83 are disposed such that the edge 84 is adjacent to the edge 86 and the edge 88 is adjacent to the edge 90.

As the guide plates 81 to 83 have the above structure, the cutout 89 and the protrusion 91 of the joint portion (adjacent portion) of the guide plats 82 and 83 have a different direction from that of the joint portion (adjacent portion) of the guide plates 41 and 42. However, the guide plates 81 to 83 works in the same manner with the guide plates 40*b*, 41*b* and 42*b*.

Figure 8:
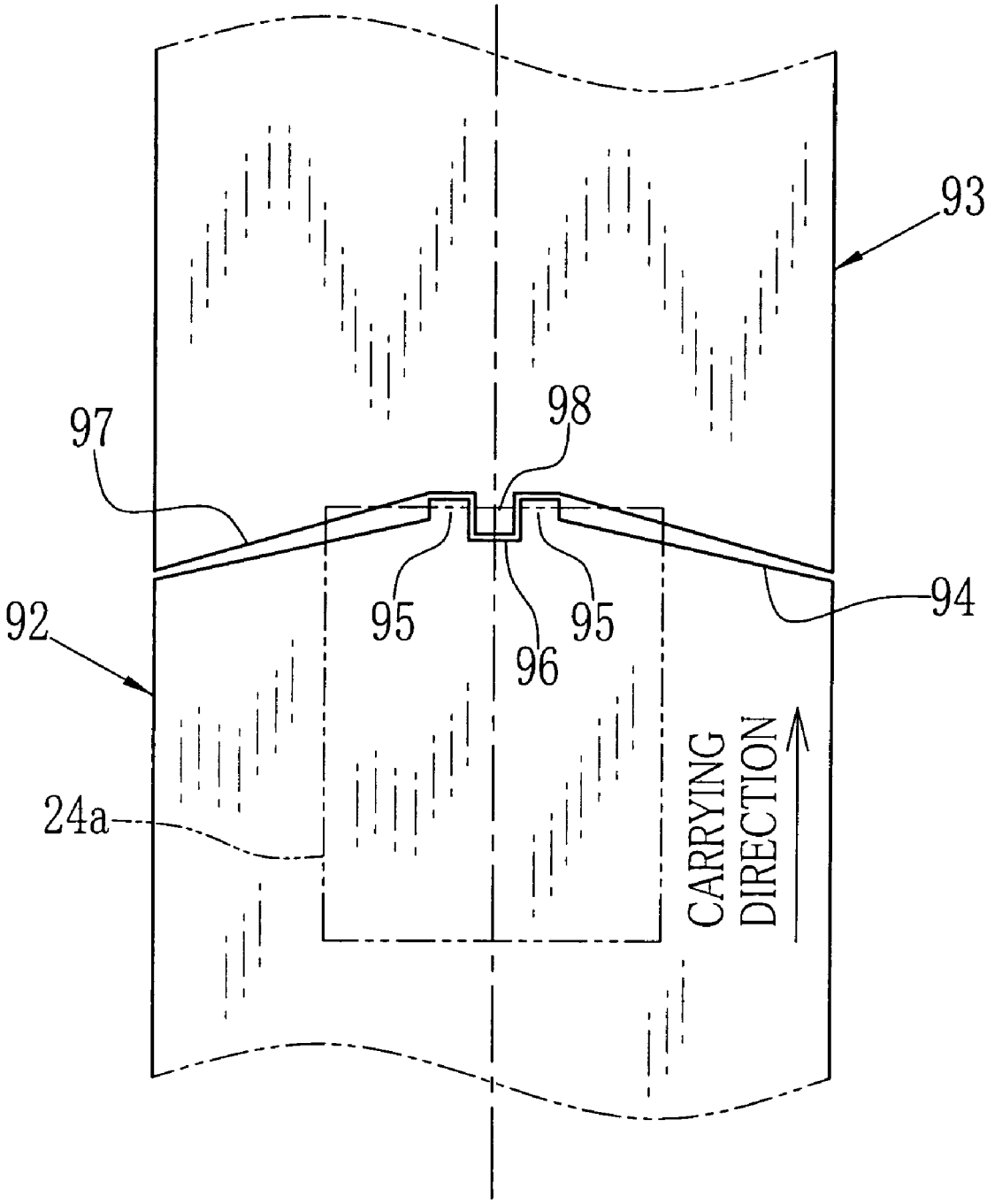
FIG. 8 is a development elevation explaining the other embodiment of the guide plate.

Regarding the protrusions 52 and 54 and the cutouts 46 and 62, the shapes thereof are not limited to the forgoing embodiment. For instance, guide plates 92 and 93 may be arranged such as shown in FIG. 8. The guide plate 92 is disposed at an upstream side of the guide plate 93. A downstream edge 94 of the guide plate 92 has a convex shape (reversed-V shape) toward the downstream side such that a width thereof gradually reduces from lateral sides to the center in the scanning direction. A central portion of the downstream edge 94 is formed with two projections 95 projecting to the guide plate 93. The protrusions 95 have a rectangular shape, and a cutout 96 is formed between the projections 95. This cutout 96 is a concave portion having a rectangular shape.

An upstream edge 97 of the guide plate 93 has a concave shape (V shape) toward the upstream side so as to correspond to the shape of the downstream edge 94 of the guide plate 92. A central portion of the upstream edge 97 is formed with a protrusion 98 projecting to the guide plate 92. The protrusion 98 has a rectangular shape and a size thereof is smaller than that of the cutout 96. Further, the protrusion 98 inclines downward toward the upstream guide plate 92.

The guide plates 92 and 93 are arranged such that the edge 94 is adjacent to the edge 97. The protrusion 98 is adjacent to the cutout 96 so as to mesh with each other. At this time, the top of the protrusion 98 is positioned under the cutout 96.

In this way, the protrusion and the cutout may have the rectangular shape. Alternatively, protrusions formed on the adjacent edges of the guide plates may mesh with each other. Also in this case, the guide plates work in the same manner with the guide plates 40*b*, 41*b* and 42*b*. Meanwhile, numbers of the protrusions and the cutouts are not limited to the foregoing embodiment, but may be optional within the minimum width of the photosensitive material 24*a*.

In the above embodiments, the adjacent edges of the guide plates are straightly formed. However, this is not exclusive. The adjacent edges may be curved.

In the forgoing embodiment, the sheet-material carrying device according to the present invention is applied to the skew-correcting device of the photographic printer. However, this is not exclusive. The sheet-material carrying device is sufficient to comprise a plurality of guide members for guiding the sheet material in the carrying direction. For instance, the present invention may be applied to sheet-material carrying devices of a thermal printer, an ink-jet printer, a scanner, a sheet feeder for the exposing device of the photographic printer, and so forth. In addition, the present invention may be applied to sheet-material carrying devices of a copying machine utilizing an electrophotographic method (electrostatic image transfer method), a pictography (laser exposure, and thermal development transfer type), and so forth.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A sheet-material carrying device for carrying a sheet material in a carrying direction thereof, comprising:

a first guide member disposed along said carrying direction of said sheet material to guide said sheet material in said carrying direction, a downstream edge of said first guide member having a convex shape in said carrying direction such that a breadth thereof in a width direction perpendicular to said carrying direction gradually becomes narrower from both sides toward its center; and a second guide member disposed along said carrying direction of said sheet material to guide said sheet material in said carrying direction, an upstream edge of said second guide member having a concave shape corresponding to the convex shape of the downstream edge of said first guide member, wherein said first and second guide members are disposed so as to make said downstream edge and said upstream edge adjacent, and wherein the center of one of said downstream and upstream edges is formed with a protrusion projecting toward the other thereof, and the center of the other of said downstream and upstream edges is formed with a cutout having a size larger than said protrusion, said first and second guide members being adjacent so as to enter said protrusion into said cutout.

2. A sheet-material carrying device according to claim 1, wherein a length of said protrusion in said width direction gradually becomes narrower, and a length of said cutout in said width direction gradually becomes wider so as to correspond to said protrusion.

3. A sheet-material carrying device according to claim 2, wherein said protrusion is formed at said downstream edge of said first guide member and slopes downward toward said upstream edge of said second guide member, the top of said protrusion being positioned under said cutout.

4. A sheet-material carrying device according to claim 1, wherein said protrusion and said cutout have a rectangular shape.

5. A sheet-material carrying device according to claim 4, wherein said cutout is formed at said downstream edge of said first guide member and is formed between two projections projecting from said downstream edge toward said upstream edge of said second guide member.

6. A sheet-material carrying device according to claim 1, wherein at least one of said first and second guide members has a curvature to curve said carrying direction of said sheet material in an arc shape.

7. A sheet-material carrying device according to claim 1, further comprising:

a skew corrector for correcting a skew of said sheet material so as to make an anterior end of said sheet material parallel to said width direction, said skew corrector correcting the skew of said sheet material by adjusting an inclination of one of said first and second guide members in said width direction.

8. A sheet-material carrying device according to claim 1, further comprising:

a carrying roller for carrying said sheet material, said carrying roller being manually rotatable in a reverse direction to said carrying direction.

9. The sheet material carrying device according to claim 1, wherein a change in slope of an edge of the convex shape of the first guide member increases from an edge of the first guide member to a center point of the first guide member, in a direction perpendicular to the carrying direction, and wherein a change in slope of an edge of the concave shape of the second guide member increases from an edge of the second guide member to a center point of the second guide member, in a direction perpendicular to the carrying direction.

* * * * *